US005156643A

United States Patent [19]

Grubek

[11] Patent Number: 5,156,643

[45] Date of Patent: Oct. 20, 1992

[54] DART GAME SYSTEM

[76] Inventor: David A. Grubek, 27 W. 706 Holly Ct., West Chicago, Ill. 60185

[21] Appl. No.: 800,055

[22] Filed: Nov. 27, 1991

[51] Int. Cl.[5] ..... F41J 3/02; A63F 9/22

[52] U.S. Cl. ..... 273/376; 273/148 B; 273/435; 273/DIG. 28

[58] Field of Search ..... 273/371-377, 273/310-312, 148 B, 434, 435, 438, DIG. 28

[56] References Cited

U.S. PATENT DOCUMENTS

| | | | |
|---|---|---|---|
| 232,424 | 9/1880 | Ullman | 273/375 |
| 1,316,792 | 9/1919 | Hanson | 248/674 |
| 2,894,752 | 7/1959 | Simjian | 273/185 |
| 4,266,776 | 5/1981 | Goldfarb | 273/310 |
| 4,357,014 | 11/1982 | Baer et al. | 273/85 |
| 4,522,409 | 6/1985 | Kobayashi | 273/316 |
| 4,561,660 | 12/1985 | Zammuto | 273/376 |
| 4,824,121 | 4/1989 | Beall et al. | 273/376 |
| 4,924,216 | 5/1990 | Leung | 273/438 |
| 5,026,053 | 6/1991 | Paterson et al. | 273/3 R |

FOREIGN PATENT DOCUMENTS

| | | | |
|---|---|---|---|
| 2198656 | 6/1988 | United Kingdom | 273/376 |

*Primary Examiner*—Benjamin H. Layno

*Attorney, Agent, or Firm*—Trexler, Bushnell, Giangiorgi & Blackstone, Ltd.

[57] ABSTRACT

An electronic dart game system including, in combination, an electronic dartboard, a programmable electronic controller system, and a display monitor for displaying score totals and related data. Preferably, the electronic dartboard is of the type commonly found in stand-alone modern electronic dart games constructed of molded plastic and having a plurality of holes formed therein which correspond in diameter to that of a flexible plastic dart tip. The programmable electronic controller system is preferably a home video game controller, such as a Nintendo ® control deck, capable of receiving program cartridges containing a variety of game programs, and the display means is preferably a conventional television set.

7 Claims, 1 Drawing Sheet

FIG.1
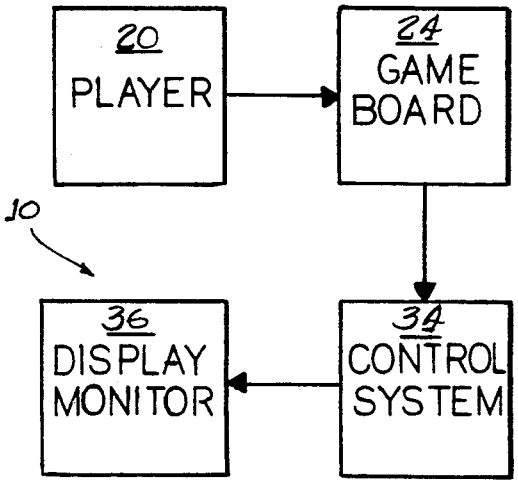
FIG.2
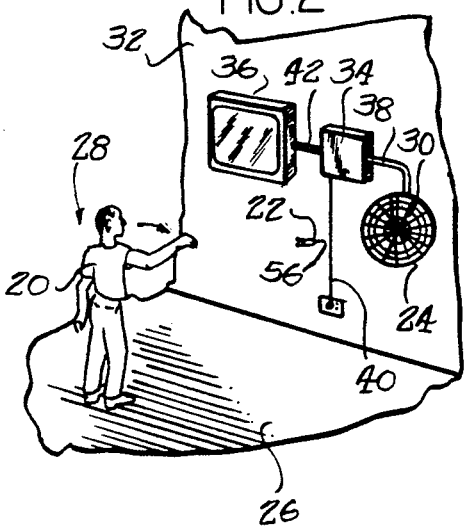
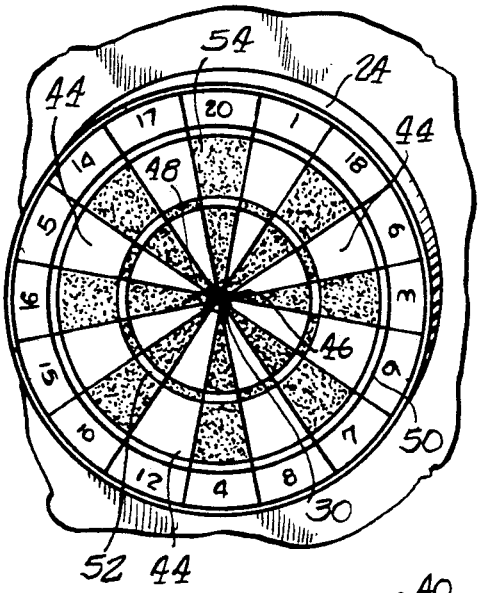
FIG.3
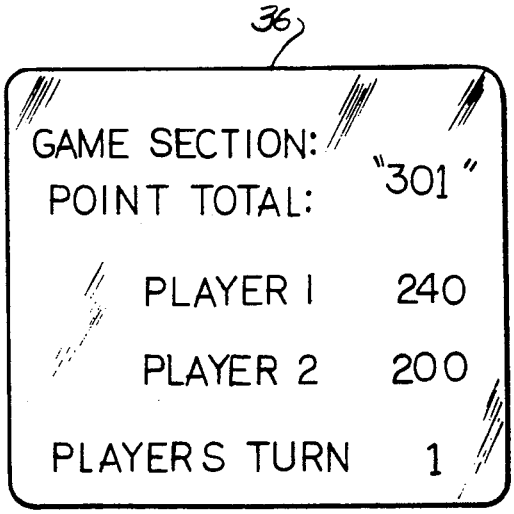
FIG.5
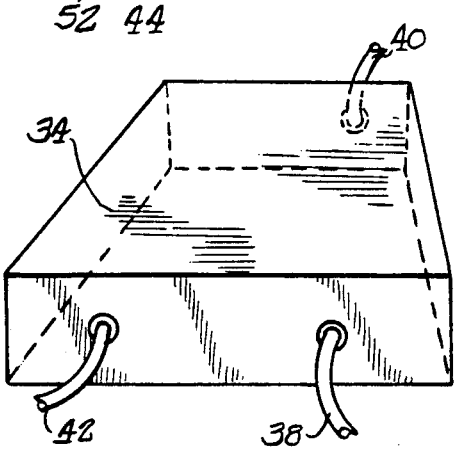
FIG.4

DART GAME SYSTEM

BACKGROUND OF THE INVENTION a. Field of the Invention

In general, the present invention relates to amusement devices. More specifically, the present invention pertains to a dart game system including an electronic dartboard, a programmable electronic control system, and a display monitor for displaying score totals and related data.

b. Description of Related Prior Art

The game of darts has been played for many decades. It originated as an English pub game and has since become very popular in several countries. In the United States, for example, dart leagues and tournaments are now very common across the country.

In its simplest form, the game involves throwing a small projectile, or dart, toward a target to score points. The standard target, or dartboard, is circular in shape, measures 18 inches in diameter and is divided into twenty (20) equal wedge-shaped segments, all intersecting at the center of the circular board, and all representing a scoring area, ie., one (1) to twenty (20) points, but not in sequential order.

Additional scoring segments on a standard dartboard include a concentric circular area having a diameter of one-half of an inch commonly referred to as the "double bulls-eye"; a concentric annular area having a diameter of one and one-half inches and a thickness of one-half of an inch surrounding the "double bulls-eye" and commonly referred to as the "single bulls-eye"; a concentric annular area having a diameter of nine and one-half inches and a thickness of one-half of an inch commonly referred to as a "triple-ring", and; a concentric annular area having a diameter of fifteen and one-half inches and a thickness of one-half of an inch commonly referred to as a "double-ring".

Until recently, most darts were constructed of a pointed metal shaft (brass being most common) at one end, and a feathered flight, or tail (turkey feathers being most common) at the other. Dartboards were usually constructed of cork or bristol board.

While these "conventional" darts and boards are still widely used today, the clear trend in the game of darts is toward what is commonly referred to as "soft-tip" or "safe" darts which utilizes darts having flexible plastic tips and molded plastic dartboards usually having a plurality of holes, corresponding in diameter to that of the flexible plastic dart tip, spread across the twenty (20) wedge-shaped scoring segments of a standard target. Use of "soft-tip" darts and molded plastic boards is found primarily in modern electronic dart games such as those shown in Zammuto, U.S. Pat. No. 4,561,660, Tillery et al., U.S. Pat. No. 4,793,618 and Beall et al, U.S. Pat. No. 4,824,121, although non-electronic dart games of this type are also readily available. Electronic dart games such as those shown in the abovereferenced patents also have the distinct advantage of electronically recording and displaying the game score totals thereby merely requiring a dart game player to initialize the game and throw darts. Keeping score totals manually on a pad or chalkboard is no longer necessary. As a result, electronic dart games such as those shown in the above-referenced patents are now routinely found in taverns, arcades and restaurants across the nation.

The weight, dimensions and expense of such an electronic dart game, however, limits the practical usage of such a device to commercial locations. On average, the devices stand seven (7) feet tall, are approximately two (2) feet wide and weigh in excess of 400 pounds. Moreover, the average cost of such a device can be over of $3,000.00. Accordingly, one would not expect to normally find an electronic dart game of the variety discussed in a private den or recreation room in one's home.

OBJECTS AND SUMMARY OF THE INVENTION

A general object of the present invention is to provide an amusement device suitable for home use.

A more specific objective of the present invention is to provide an electronic dart game system which is both practical for home use and affordable.

An associated objective is to provide an electronic dart game system which includes common components having independent utility. A related objective of the present invention is to provide an electronic dart game system which includes control means comprising a home video computer and a television set.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which:

FIG. 1 is a block diagram illustrating the basic flow and individual components of the dart game system;

FIG. 2 is a perspective view of the dart game system arranged for use in a home setting;

FIG. 3 is a front view of the target component of the present invention;

FIG. 4 is a perspective view of the electronic controller component of the invention, and;

FIG. 5 is a perspective view of the display monitor component of the invention with representative data displayed thereon.

DETAILED DESCRIPTION OF THE PREFERRED EMBODIMENT

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Turning to FIG. 1, the basic concept of the unique dart game system 10 of the present invention is illustrated in block diagram form. After an initialization operation (discussed in detail below) a player, represented by block 20, interacts with a target, identified as a gameboard at block 24, thereby causing electronic signals produced by the target 24 to be transmitted to a control system, shown as block 34. The control system 34, in turn processes and converts the signals received from the target 24 into recognizable scoring patterns which are sent and displayed on a monitor, represented by block 36.

Referring now to FIG. 2, it is seen that in using the embodiment disclosed, the player 20 throws a dart, or other small projectile 22, at the gameboard 24. The gameboard 24 is preferably suspended and fixed in place above a floor surface 26 of a basement or recreation room 28, such that the center 30 of the gameboard 24 is elevated sixty-eight inches (68") from the floor surface 26. In addition, the person 20 hurling the dart 22 at the gameboard 24 should be located seven feet, nine and one-half inches (7'9.5") away from a wall 32 upon which the gameboard 24 is suspended. So arranged, the person 20 and gameboard 24 are in compliance with the distance rules promulgated by the E.M.D.I.A.

Still referring to FIG. 2, it can be seen that the dart game system 10 further comprises a programmable electronic controller 34 and a display monitor 36, preferably in the form of a conventional television set. Electronic interconnection between the gameboard 24 and the controller 34 is provided by first signal interface 38 as shown. The controller 34 is energized by a power source 40 and communicates with the television 36 via second signal interface 42. Power source 40 is also used to energize the television monitor 36.

To operate the game system 10, the controller 34 must first be energized and initialized. Preferably, the controller 34 (shown apart from the other components in FIG. 4) is in the form of a modern home video game system, such as a Nintendo Entertainment System ®, capable of being programmed to receive and translate electrical signals from a remote source, such as the gameboard 24, convert the signals received into data associated with and recorded on a predetermined scoring pattern, and then retransmit the data containing scoring pattern in to a recognizable format.

Moreover, the first signal interface 38 is preferably adapted to be received by the controller ports (not shown) of a conventional Nintendo Entertainment System ®, or similar device, which are normally used to connect the joystick controller apparatus of the system itself. Signal transmission and reception between the gameboard 24 and controller 34, and between the controller 34 and display 36 are known in the art as illustrated by one or more of U.S. Pat. Nos. 4,813,682; 4,815,733, and; 4,984,193 which are hereby incorporated by reference. Wireless electromagnetic transmission in an infrared frequency range may also be utilized as a means of sending signals from the gameboard 24 to the controller 34, as will be understood upon reference to U.S. Pat. No. 4,924,216 which is also incorporated herein.

The software programs for the controller 34 may be carried on a game cartridge (not shown) and contain programming for initializing and formating popular dart games such as "Regulation", "301", "501", "Baseball" and "Football" etc. Controller programming may also take several other forms including complex video imaging and audio signals. Accordingly, the scope of the invention is not intended to be limited in this regard.

For purposes of providing a more complete description of the present game system 10, however, its operation will be described in connection with the popular dart game of "301" wherein each person 20 begins play with a point total of three-hundred and one (301), the object being to reduce one's point total to exactly zero (0) by landing darts 22 on the various scoring segments of the gameboard 24. Accordingly, after initializing the controller 34 and selecting the "301" game, the person(s) 20 playing the game throws darts 22 in a predetermined sequence and in accordance with the "301" game rules at the gameboard 24.

Referring now to FIG. 3, the gameboard component 24 is illustrated apart from the remaining elements of the game system 10. The gameboard 24 is designed as a standard dartboard having twenty (20) equal wedge-shaped scoring segments 44 converging at the center 30 of the gameboard 24. As discussed above, a "double bulls-eye" 46, "single bulls-eye" 48, "double ring" 50 and "triple ring" 52 are also included in the standard scoring pattern design illustrated.

Preferably, the gameboard 24 is of the type commonly used in conjunction with a modern stand-alone "tavern-type" electronic dart game such as discussed in detail in U.S. Pat. No. 4,057,251, U.S. Pat. No. 4,793,618 and U.S. Pat. No. 4,586,716, which are all incorporated herein by reference. Details relating to the construction, operation and circuitry of the gameboard 24 are disclosed in the above-mentioned United States Patents, and are therefore omitted here. Briefly stated, however, the gameboard 24 includes a series of wafer-like target plates 54 substantially corresponding in size and operatively associated with the various individual wedge-shaped scoring segments 44, "double bulls-eye" 46, "single bulls-eye" 48, "double ring" 50 and "triple ring" 52. Each target plate 54 is formed with a large number of closely spaced apertures (not shown in detail) corresponding in diameter to the diameter of a dart tip 56 and mounted for inward movement relative to the remaining components of the gameboard 24 upon impact of an incoming dart 22. When the thrown dart 22 reaches the gameboard 24, the dart tip 56 becomes lodged in one of the many closely spaced apertures and causes the target plate 54 associated therewith to move inward and close one of a matrix of electrical switches thereby generating an electronic signal which is then transmitted from the gameboard 24 to the controller 34 by a first signal interface 38.

The signals received by the controller 34 are processed in accordance with the programming associated with the particular game selected, such as "301", and transmitted to the television 36 by the second signal interface 42, thereby enabling viewing of the scoring pattern by the person 20 throwing the dart 22.

FIG. 5 illustrates an exemplary display on the television 36. Upon close inspection of FIG. 5, it will be seen that the game selection is "301" and the game is in-process. Player 1 has reduced its total to 240 points, player 2 has reduced its total to 200 points, and player 1 is currently throwing.

While a preferred embodiment of the unique combination of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention is claimed as follows:

1. An electronic dart game system suitable for home usage, said system comprising:

a. target means for recognizing the contact of a projectile and for generating an electronic signal in response to the contact of said projectile;

b. first interface means for transmitting said signal generated in response to said projectile contacting said target;

c. controller means comprising a home video game system to operate in conjunction with a removable computer programming cartridge for receiving said signal from said first interface means and processing said signal in accordance with predetermined programming held in storage by said controller means, said controller means further comprising means for generating a second signal;

d. second interface means for transmission of said second signal generated by said controller means, and;

e. display means for receiving said second signal generated by said controller means and for displaying said second signal in a recognizable scoring pattern format to a player using said electronic dart game system.

2. The electronic dart game system recited in claim 1, wherein said target means comprises an electronic dartboard having a plurality of apertures adapted to receive and retain a dart having a flexible plastic tip and generate a transmittable electronic signal upon receipt thereof.

3. The electronic dart game system recited in claim 1, wherein said display means comprises a television set.

4. The electronic dart game system recited in claim 1, wherein said computer program cartridges contain complex video imaging and audio data.

5. The electronic dart game system recited in claim 1, wherein said computer program cartridges contain programming for operating popular dart games, examples of which include "Regulation", "301", "501", "Baseball" and "Football".

6. The electronic dart game system recited in claim 1, wherein said display means comprises a home computer monitor.

7. The electronic dart game system recited in claim 1, wherein said first interface means comprises wireless electromagnetic transmission apparatus.

* * * * *